US009447971B2

(12) United States Patent
Kim et al.

(10) Patent No.: US 9,447,971 B2
(45) Date of Patent: Sep. 20, 2016

(54) ACOUSTIC RESONATOR LOCATED AT FLOW SLEEVE OF GAS TURBINE COMBUSTOR

(75) Inventors: Kwanwoo Kim, Cincinnati, OH (US); Fei Han, Niskayuna, NY (US); Praveen Jain, Karnataka (IN); Venkat Narra, Greenville, SC (US); Sven Georg Bethke, Niskayuna, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 1021 days.

(21) Appl. No.: 13/461,908

(22) Filed: May 2, 2012

(65) Prior Publication Data

US 2013/0291543 A1 Nov. 7, 2013

(51) Int. Cl.
*F23R 3/04* (2006.01)
*F23R 3/00* (2006.01)

(52) U.S. Cl.
CPC ..... *F23R 3/002* (2013.01); *F23R 2900/00014* (2013.01)

(58) Field of Classification Search
CPC .. F01D 9/023; F01D 25/12; F05D 2260/201; F05D 2260/96; F23R 2900/03044; F23M 20/005
USPC ..... 60/725
See application file for complete search history.

(56) References Cited

U.S. PATENT DOCUMENTS

| | | | | |
|---|---|---|---|---|
| 4,719,748 | A * | 1/1988 | Davis et al. | 60/39.37 |
| 5,644,918 | A | 7/1997 | Gulati et al. | |
| 7,413,053 | B2 | 8/2008 | Wasif et al. | |
| 7,461,719 | B2 | 12/2008 | Tobik et al. | |
| 2002/0078676 | A1* | 6/2002 | Ono et al. | 60/725 |
| 2002/0088233 | A1* | 7/2002 | Ohnishi et al. | 60/725 |
| 2007/0169992 | A1 | 7/2007 | Wasif et al. | |
| 2008/0041058 | A1 | 2/2008 | Johnson et al. | |
| 2010/0223931 | A1* | 9/2010 | Chila et al. | 60/760 |
| 2011/0179795 | A1 | 7/2011 | Johnson et al. | |
| 2012/0198854 | A1* | 8/2012 | Schilp et al. | 60/755 |
| 2013/0042619 | A1* | 2/2013 | Bobba et al. | 60/725 |

FOREIGN PATENT DOCUMENTS

JP 2007-132640 * 5/2007

OTHER PUBLICATIONS

Search Report from EP Application No. 13166011.0 dated Nov. 28, 2013.

* cited by examiner

*Primary Examiner* — Ted Kim
(74) *Attorney, Agent, or Firm* — Nixon & Vanderhye P.C.

(57) ABSTRACT

A system includes a compressor that compresses incoming airflow, and a combustor assembly mixing the compressed incoming airflow with fuel and combusting the air and fuel mixture in a combustion zone. The combustor assembly includes a hot side downstream of the combustion zone and a cold side upstream of the combustion zone. The system also includes a turbine receiving products of combustion from the combustor. The combustor assembly includes a resonator positioned in the cold side of the combustor assembly in an annular passage between a flow sleeve and a casing of the combustor assembly.

16 Claims, 3 Drawing Sheets

ACOUSTIC RESONATOR LOCATED AT FLOW SLEEVE OF GAS TURBINE COMBUSTOR

BACKGROUND OF THE INVENTION

The invention relates to a combustor assembly for a gas turbine and, more particularly, to a DLN combustor assembly including an acoustics resonator.

Gas turbine systems typically include at least one gas turbine engine having a compressor, a combustor assembly, and a turbine. The combustor assembly may use dry, low NOx (DLN) combustion. In DLN combustion, fuel and air are pre-mixed prior to ignition, which lowers emissions. However, the lean pre-mixed combustion process is susceptible to flow disturbances and acoustic pressure waves. More particularly, flow disturbances and acoustic pressure waves could result in self-sustained pressure oscillations at various frequencies. These pressure oscillations may be referred to as combustion dynamics. Combustion dynamics can cause structural vibrations, wearing, and other performance degradations.

It is desirable to suppress combustion dynamics in a DLN combustor below specified levels to maintain low emissions. For axial mode frequencies, which are typically below 500 Hz, combustion dynamics can be effectively controlled using acoustic resonators provided at optimal locations.

BRIEF DESCRIPTION OF THE INVENTION

In an exemplary embodiment, a gas turbine combustor assembly includes a casing defining an external boundary of the combustor assembly, and a plurality fuel nozzles disposed in the casing and coupled with a fuel supply. A liner receives fuel and air from the fuel nozzles and defines a combustion zone, and a flow sleeve is disposed between the liner and the casing. The flow sleeve serves to distribute compressor discharge air to a head end of the combustor assembly and to cool the liner. A transition piece is coupled with the liner and delivers products of combustion to a turbine. A resonator is disposed adjacent the flow sleeve upstream of the transition piece. The resonator serves to attenuate combustion dynamics.

In another exemplary embodiment, a system includes a compressor that compresses incoming airflow, a combustor assembly mixing the compressed incoming airflow with fuel and combusting the air and fuel mixture in a combustion zone, and a turbine receiving products of combustion from the combustor. The combustor assembly includes the noted casing, fuel nozzles, liner, flow sleeve, transition piece and resonator.

In yet another exemplary embodiment, a system includes a compressor that compresses incoming airflow, and a combustor assembly mixing the compressed incoming airflow with fuel and combusting the air and fuel mixture in a combustion zone. The combustor assembly includes a hot side downstream of the combustion zone and a cold side upstream of the combustion zone. The system also includes a turbine receiving products of combustion from the combustor. The combustor assembly includes a resonator positioned in the cold side of the combustor assembly in an annular passage between a flow sleeve and a casing of the combustor assembly.

DETAILED DESCRIPTION OF THE INVENTION

As described above, gas turbine systems include combustor assemblies which may use a DLN or other combustion process that is susceptible to flow disturbances and/or acoustic pressure waves. Specifically, the combustion dynamics of the combustor assembly can result in self-sustained pressure oscillations that may cause structural vibrations, wearing, mechanical fatigue, thermal fatigue, and other performance degradations in the combustor assembly. One technique to mitigate combustion dynamics is the use of a resonator, such as a Helmholtz resonator. Specifically, a Helmholtz resonator is a damping mechanism that includes several narrow tubes, necks, or other passages connected to a large volume. The resonator operates to attenuate and absorb the combustion tones produced by the combustor assembly. The depth of the necks or passages and the size of the large volume enclosed by the resonator may be related to the frequency of the acoustic waves for which the resonator is effective.

Figure 1:
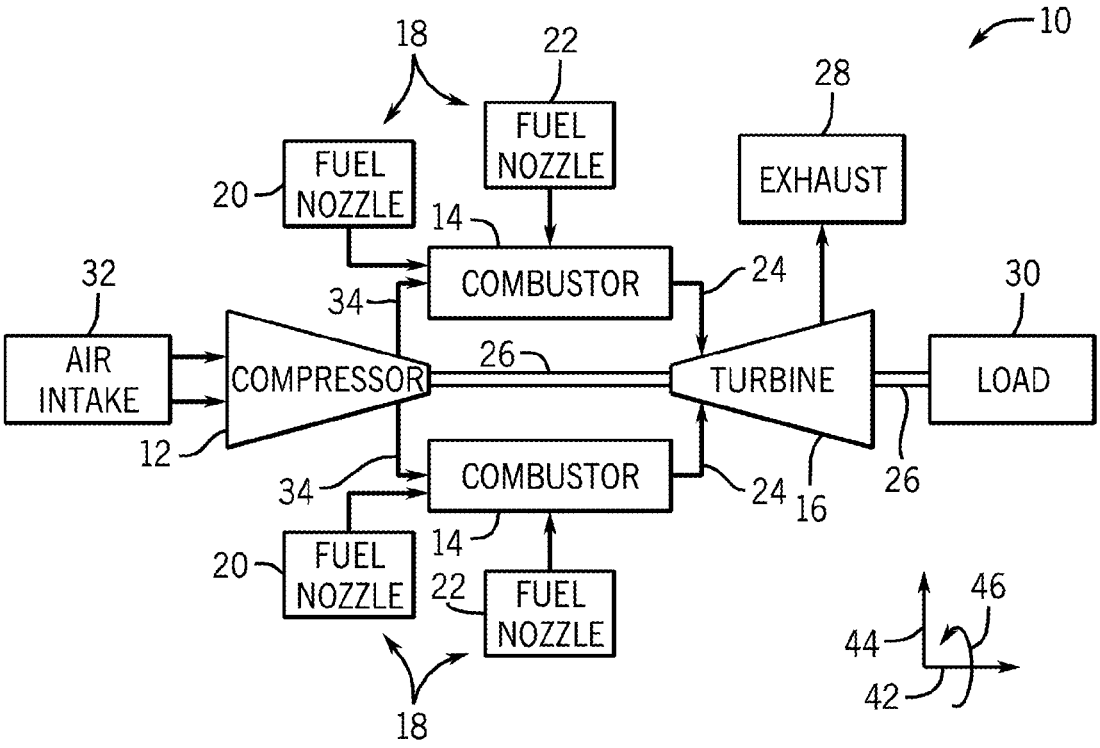
FIG. 1 is a block diagram of an exemplary gas turbine system.

FIG. 1 is a block diagram of an embodiment of a gas turbine system 10. The gas turbine system 10 includes a compressor 12, combustor assemblies 14, and a turbine 16. In the following discussion, reference may be made to an axial direction or axis 42, a radial direction or axis 44, and a circumferential direction or axis 46 of the combustor 14. The combustor assemblies 14 include fuel nozzles 18 which route a liquid fuel and/or gas fuel, such as natural gas or syngas, into the combustor assemblies 14. As illustrated, each combustor assembly 14 may have multiple fuel nozzles 18. More specifically, the combustor assemblies 14 may each include a primary fuel injection system having primary fuel nozzles 20 and a secondary fuel injection system having secondary fuel nozzles 22. Fuel nozzles can have multiple circuits, e.g., a total of six fuel nozzles, wherein one of them is independently fueled, a group of two fuel nozzles may have an independent fuel circuit, and a group of three fuel nozzles may have another independent circuit. Regardless of the arrangement and grouping of fuel nozzles, the combustor assembly includes multiple independent fuel circuits.

The combustor assemblies 14 illustrated in FIG. 1 ignite and combust an air-fuel mixture, and then pass hot pressurized combustion gasses 24 (e.g., exhaust) into the turbine 16. Turbine blades are coupled to a common shaft 26, which is also coupled to several other components throughout the turbine system 10. As the combustion gases 24 pass through the turbine blades in the turbine 16, the turbine 16 is driven into rotation, which causes the shaft 26 to rotate. Eventually, the combustion gases 24 exit the turbine system 10 via an exhaust outlet 28. Further, the shaft 26 may be coupled to a load 30, which is powered via rotation of the shaft 26. For example, the load 30 may be any suitable device that may generate power via the rotational output of the turbine system 10, such as a power generation plant or an external mechanical load. For instance, the load 30 may include an electrical generator, a propeller of an airplane, and so forth.

In an embodiment of the turbine system 10, compressor blades are included as components of the compressor 12. The blades within the compressor 12 are also coupled to the shaft 26, and will rotate as the shaft 26 is driven to rotate by the turbine 16, as described above. The rotation of the blades within the compressor 12 compresses air from an air intake 32 into pressurized air 34. The pressurized air 34 is then fed into the fuel nozzles 18 of the combustor assemblies 14. The fuel nozzles 18 mix the pressurized air 34 and fuel to produce a suitable mixture ratio for combustion (e.g., a combustion that causes the fuel to more completely burn) so as not to waste fuel or cause excess emissions.

Figure 2:
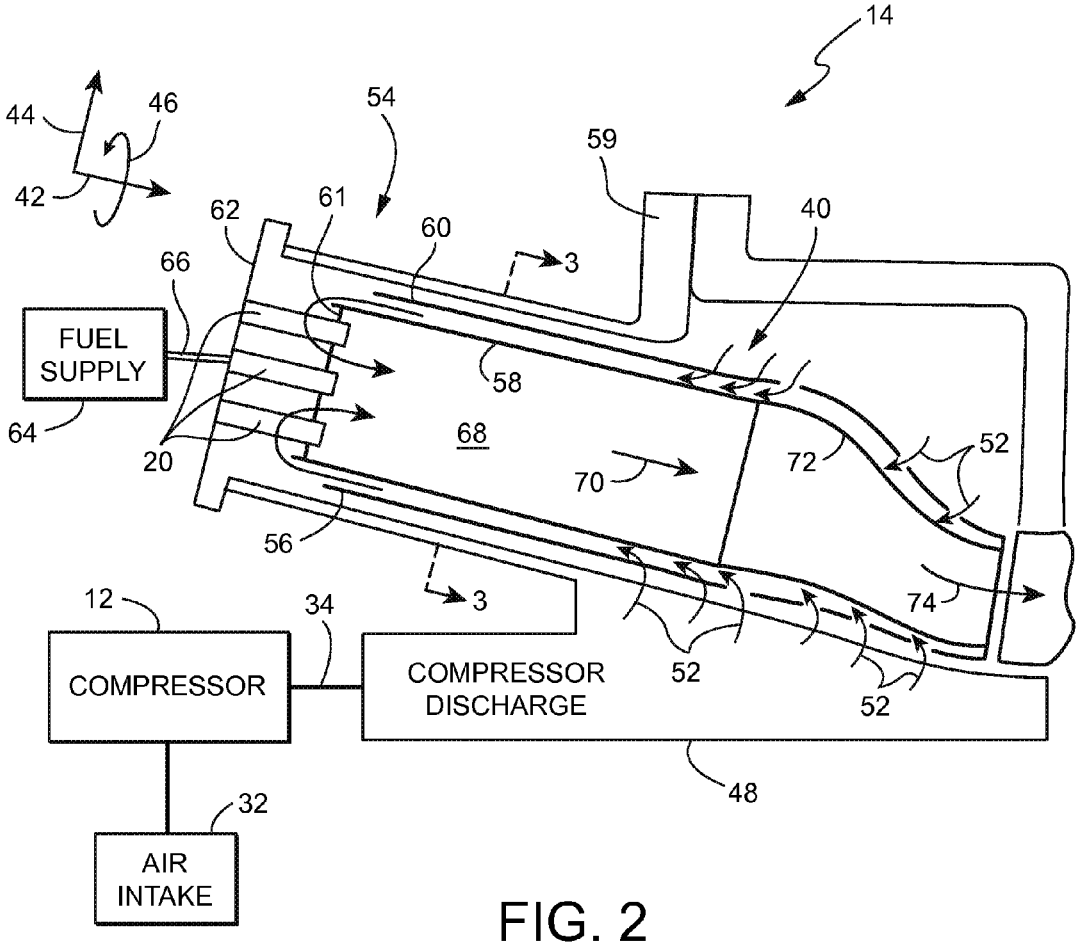
FIG. 2 is a schematic diagram of a combustor assembly.

FIG. 2 is a schematic diagram of one of the combustor assemblies 14 of FIG. 1, illustrating an embodiment of a resonator 40 disposed in cooperation with the combustor assembly 14. As described above, the compressor 12 receives air from an air intake 32, compresses the air, and produces a flow of pressurized air 34 for use in the combustion process within the combustor 14. As shown in the illustrated embodiment, the pressurized air 34 is received by a compressor discharge 48 that is operatively coupled to the combustor assembly 14. As illustrated by arrows 52, the pressurized air 34 flows from the compressor discharge 48 towards a head end 54 of the combustor 14. More specifically, the pressurized air 34 flows through an annulus 56 between a liner 58 and a flow sleeve 60 of the combustor assembly 14 to reach the head end 54. A casing serves as an external boundary or housing of the combustor assembly.

In certain embodiments, the head end 54 includes plates 61 and 62 that may support the fuel nozzles 20 depicted in FIG. 1. In the embodiment illustrated in FIG. 2, a fuel supply 64 provides fuel 66 to the fuel nozzles 20. Additionally, the fuel nozzles 20 receive the pressurized air 34 from the annulus 56 of the combustor assembly 14. The fuel nozzles 20 combine the pressurized air 34 with the fuel 66 provided by the fuel supply 64 to form an air/fuel mixture. The air/fuel mixture is ignited and combusted in a combustion zone 68 of the combustor assembly 14 to form combustion gases (e.g., exhaust). The combustion gases flow in a direction 70 toward a transition piece 72 of the combustor assembly 14. The combustion gases pass through the transition piece 72, as indicated by arrow 74, toward the turbine 16, where the combustion gases drive the rotation of the blades within the turbine 16.

The combustor assembly 14 also includes the resonator 40 disposed between the flow sleeve 60 and the casing 59 adjacent an inlet of the flow sleeve 60. As described above, the combustion process produces a variety of pressure waves, acoustic waves, and other oscillations referred to as combustion dynamics. Combustion dynamics may cause performance degradation, structural stresses, and mechanical or thermal fatigue in the combustor assembly 14. Therefore, combustor assemblies 14 may include the resonator 40, e.g., a Helmholtz resonator, to help mitigate the effects of combustion dynamics in the combustor assembly 14.

Figure 3:
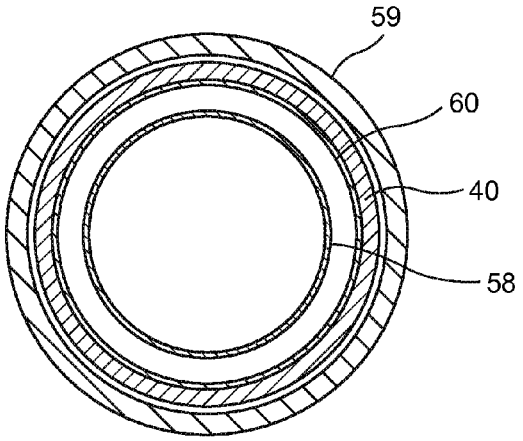
FIG. 3 is a cross-sectional end view of the combustor shown in FIG. 2.
Figure 4:
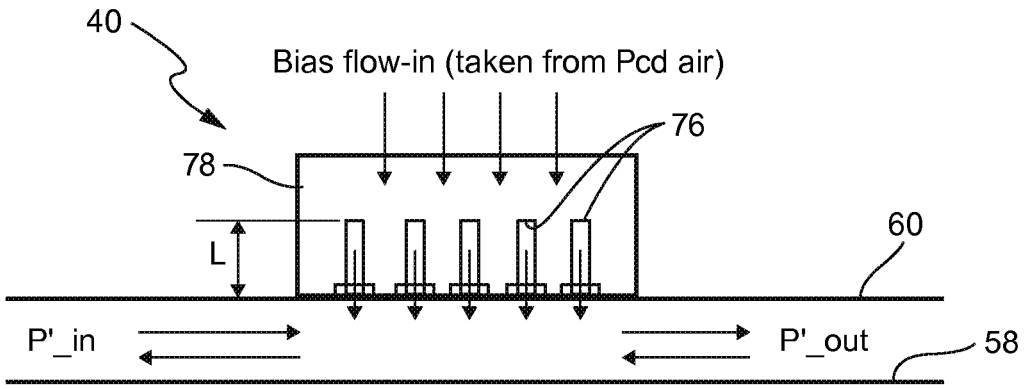
FIG. 4 is a schematic illustration showing the components of the resonator.
Figure 5:
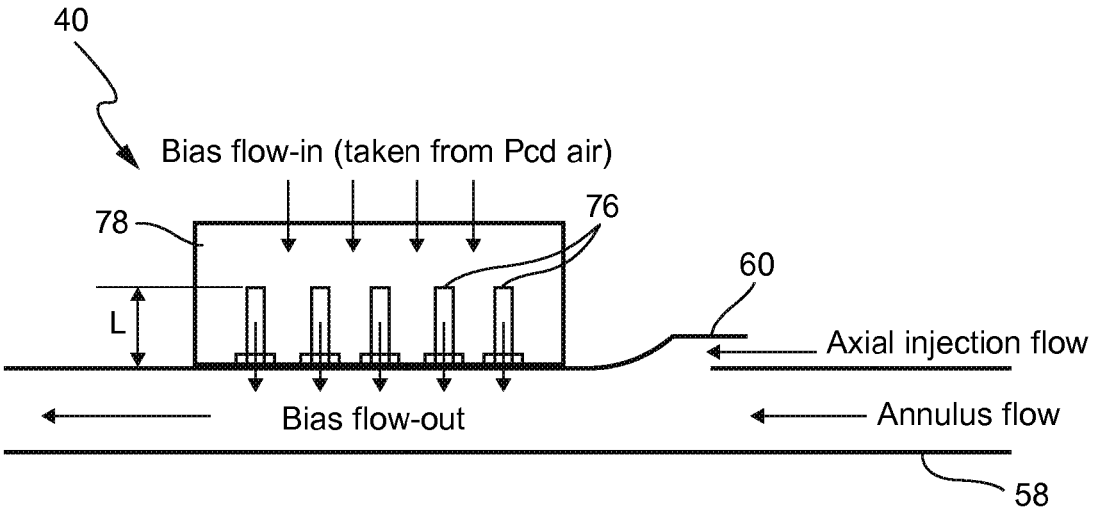
FIG. 5 is a schematic illustration with the resonator in an alternative embodiment.

As shown in FIG. 2, the resonator 40 is mounted on the flow sleeve on a cold side of the combustor assembly. FIG. 3 is a cross section along lines 3-3 in FIG. 2. As shown, the resonator 40 is preferably positioned in an annular passage between the flow sleeve and the casing 59. The resonator 40 is preferably attached to the flow sleeve 60. As shown in FIG. 4, the resonator 40 includes a volume 78 containing a plurality of tubes 76 in fluid communication with air flow between the liner 58 and the flow sleeve 60. The tubes 76 extend into an annular passage within the volume 78 between the flow sleeve 60 and the casing 59. FIG. 5 shows an alternative arrangement with the resonator 40 positioned immediately downstream of an axial injection flow sleeve. By locating the resonator 40 in this manner, high amplitude acoustic pressure can be mitigated effectively.

In FIG. 4, P' IN identifies acoustic pressure waves traveling from the combustor head end, and P' OUT identifies acoustic pressure waves traveling from the transition piece.

The resonator 40 on the flow sleeve 60 can be tuned for a targeted frequency range. Additionally, since the resonator 40 may be secured to the flow sleeve 60, it is easily replaced.

The resonator of the described embodiments serves to suppress/attenuate combustion-generated acoustics. As a consequence, operability and durability of a DLN combustor can be extended.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A gas turbine combustor assembly comprising:

a casing defining an external boundary of the combustor assembly;

a plurality of fuel nozzles disposed in the casing and coupled with a fuel supply;

a liner receiving fuel and air from the fuel nozzles, the liner defining a combustion zone;

a flow sleeve disposed between the liner and the casing and defining a cold side of the combustor assembly, the flow sleeve defining an annulus flow and distributing compressor discharge air to a head end of the combustor assembly and cooling the liner;

a transition piece coupled with the liner and delivering products of combustion to a turbine; and a resonator disposed on the cold side of the combustor assembly adjacent the flow sleeve, downstream of an axial injection flow inlet providing an injection flow into the flow sleeve, the resonator positioned downstream of a merge of injection flow and annulus flow, relative to the compressor discharge air in the flow sleeve, and upstream of the transition piece relative to a flow of combustion gases within the liner, the resonator comprising an enclosed volume tuned to attenuate combustion dynamics and having openings positioned in free fluid communication with the compressor discharge airflow directed to the head end of the combustor assembly in the flow sleeve, thereby attenuating combustion dynamics.

2. A gas turbine combustor assembly according to claim 1, comprising an annular passage between the flow sleeve and the casing, wherein the resonator is disposed in the annular passage.

3. A gas turbine combustor assembly according to claim 2, wherein the resonator is attached to the flow sleeve.

4. A gas turbine combustor assembly according to claim 1, wherein the resonator is attached to the flow sleeve.

5. A gas turbine combustor assembly according to claim 4, wherein the resonator is attached to the flow sleeve adjacent the axial injection flow inlet of the flow sleeve.

6. A gas turbine combustor assembly according to claim 1, wherein the resonator is positioned adjacent the axial injection flow inlet of the flow sleeve.

7. A gas turbine combustor assembly according to claim 1, wherein the resonator is a Helmholtz resonator.

8. A gas turbine combustor assembly according to claim 7, wherein the resonator comprises a plurality of tubes in fluid communication with airflow between the liner and the flow sleeve, the plurality of tubes extending into the volume.

9. A gas turbine combustor assembly according to claim 1, wherein the resonator is tuned for a targeted frequency range.

10. A system comprising:

a compressor that compresses incoming airflow;

a combustor assembly mixing the compressed incoming airflow with fuel, and combusting the air and fuel mixture in a combustion zone; and a turbine receiving products of combustion from the combustor, wherein the combustor assembly includes:

a casing defining an external boundary of the combustor assembly, a plurality of fuel nozzles disposed in the casing and coupled with a fuel supply, a liner receiving fuel and air from the fuel nozzles, the liner defining the combustion zone, a flow sleeve defining an annulus flow and disposed between the liner and the casing and defining a cold side of the combustor assembly, the flow sleeve distributing discharge air from the compressor to a head end of the combustor assembly and cooling the liner, a transition piece coupled with the liner and delivering the products of combustion to the turbine, and a resonator disposed on the cold side of the combustor assembly adjacent the flow sleeve, downstream of an axial injection flow inlet providing an injection flow into the flow sleeve, the resonator positioned downstream of a merge of injection flow and annulus flow, relative to the compressor discharge air in the flow sleeve, and upstream of the transition piece relative to a flow of combustion gases within the liner, the resonator comprising an enclosed volume tuned to attenuate combustion dynamics and having openings positioned in free fluid communication with the compressor discharge airflow directed to the head end of the combustor assembly in the flow sleeve, thereby attenuating combustion dynamics.

11. A system according to claim 10, the combustor assembly further comprises an annular passage between the flow sleeve and the casing, wherein the resonator is disposed in the annular passage.

12. A system according to claim 10, wherein the resonator is attached to the flow sleeve.

13. A system according to claim 10, wherein the resonator is attached to the flow sleeve adjacent the axial injection flow inlet of the flow sleeve.

14. A system according to claim 10, wherein the resonator is a Helmholtz resonator.

15. A system according to claim 14, wherein the resonator comprises a plurality of tubes in fluid communication with airflow between the liner and the flow sleeve, the plurality of tubes extending into the volume.

16. A system according to claim 10, wherein the resonator is tuned for a targeted frequency range.

* * * * *